US012043442B2

(12) United States Patent
Magelli et al.

(10) Patent No.: US 12,043,442 B2
(45) Date of Patent: Jul. 23, 2024

(54) PACKAGE FORMING UNIT, PACKAGING APPARATUS HAVING A PACKAGE FORMING UNIT AND METHOD FOR FORMING PACKAGES

(71) Applicant: TETRA LAVAL HOLDINGS & FINANCE S.A., Pully (CH)

(72) Inventors: Roberto Magelli, Parma (IT); Marco Poppi, Modena (IT); Dino Neri, Modena (IT); Stefano Caselli, Modena (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 35 days.

(21) Appl. No.: 18/002,769

(22) PCT Filed: Jun. 30, 2021

(86) PCT No.: PCT/EP2021/067994
§ 371 (c)(1),
(2) Date: Dec. 21, 2022

(87) PCT Pub. No.: WO2022/017745
PCT Pub. Date: Jan. 27, 2022

(65) Prior Publication Data

US 2023/0242289 A1 Aug. 3, 2023

(30) Foreign Application Priority Data

Jul. 23, 2020 (EP) ..... 20187318

(51) Int. Cl.
*B65B 9/12* (2006.01)
*B65B 9/20* (2012.01)
(Continued)

(52) U.S. Cl.
CPC ..... *B65B 9/12* (2013.01); *B65B 9/2035* (2013.01); *B65B 9/2049* (2013.01); *B65B 41/10* (2013.01); *B65B 51/306* (2013.01); *B65B 57/16* (2013.01)

(58) Field of Classification Search
CPC ..... B65B 9/12; B65B 9/2035; B65B 9/2049; B65B 41/10; B65B 51/306; B65B 57/16; B65B 57/10
See application file for complete search history.

(56) References Cited

U.S. PATENT DOCUMENTS 4,606,174 A * 8/1986 Berg ..... B65B 39/005 53/239
4,617,779 A * 10/1986 Nygren ..... B65B 9/2049 53/511
(Continued)

FOREIGN PATENT DOCUMENTS

CN 102131707 A 7/2011
CN 109071054 A 12/2018
(Continued)

OTHER PUBLICATIONS

Office Action (The First Office Action) issued Nov. 16, 2023, by the State Intellectual Property Office of People's Republic of China in corresponding Chinese Patent Application No. 202180058961.6 and an English translation of the Office Action. (9 pages).
(Continued)

*Primary Examiner* — Hemant Desai
*Assistant Examiner* — Mobeen Ahmed
(74) *Attorney, Agent, or Firm* — BUCHANAN INGERSOLL & ROONEY PC

(57) ABSTRACT

A package forming unit comprises plural jaw units, each having at least one respective operative assembly for engaging the tube and for at least partially forming the advancing tube, one respective sealing element for at least partially
(Continued)

transversally sealing the tube along a transversal sealing band and a pair of interaction tabs for interacting with the tube. Each jaw unit is controllable as a function of the tube filling level in an operative configuration in which the respective operative assembly, the respective sealing element and the respective pair of interaction tabs are controlled in respective active states while advancing along respective operative portions and a partial operative configuration in which the respective sealing element is controlled in the respective active state and the respective operative assembly and/or the respective pair of interaction tabs is/are controlled in a respective inactive state while, in use, advancing along the respective operative portion.

15 Claims, 7 Drawing Sheets

(51) Int. Cl.

| | |
|---|---|
| ***B65B 41/10*** | (2006.01) |
| ***B65B 51/30*** | (2006.01) |
| ***B65B 57/16*** | (2006.01) |

(56) References Cited

U.S. PATENT DOCUMENTS

| | | | | |
|---|---|---|---|---|
| 4,747,253 | A * | 5/1988 | Schulte | B65B 31/006 53/511 |
| 5,001,891 | A * | 3/1991 | Abate | B29C 66/8491 53/551 |
| 6,038,838 | A * | 3/2000 | Fontanazzi | B29C 66/72321 53/551 |
| 10,449,728 | B2 * | 10/2019 | Fontanazzi | B29C 66/83513 |
| 10,875,675 | B2 * | 12/2020 | Benedetti | B65B 31/02 |
| 10,994,873 | B2 * | 5/2021 | Fontanazzi | B29C 66/82263 |
| 11,572,207 | B2 * | 2/2023 | Ferrarini | B65B 31/045 |
| 11,820,540 | B2 * | 11/2023 | Sanibondi | B65B 31/021 |
| 2001/0047641 | A1 * | 12/2001 | Kume | B65B 51/303 53/493 |
| 2002/0002810 | A1 * | 1/2002 | Nakagawa | B65B 9/207 53/437 |
| 2007/0068122 | A1 * | 3/2007 | Poppi | B65B 9/207 53/551 |
| 2010/0205911 | A1 * | 8/2010 | Fontanazzi | B65B 51/30 53/558 |
| 2011/0099955 | A1 * | 5/2011 | Konno | B65B 55/025 53/545 |
| 2011/0120059 | A1 * | 5/2011 | Andreotti | B29C 66/81427 53/451 |
| 2011/0154779 | A1 * | 6/2011 | Baba | B65B 55/025 53/111 R |
| 2011/0185686 | A1 * | 8/2011 | Konno | B29C 65/7451 53/548 |
| 2011/0192113 | A1 * | 8/2011 | Kinoshita | B65B 9/2049 53/52 |
| 2011/0308200 | A1 * | 12/2011 | Babini | B29C 66/1122 53/285 |
| 2013/0263556 | A1 * | 10/2013 | Babini | B65B 51/306 53/370.7 |
| 2018/0346159 | A1 * | 12/2018 | Ichikawa | B29C 66/4312 |
| 2019/0160758 | A1 * | 5/2019 | Fontanazzi | B29C 66/849 |
| 2020/0391895 | A1 * | 12/2020 | Pearson | B29C 65/18 |

FOREIGN PATENT DOCUMENTS

| | | | |
|---|---|---|---|
| CN | 109941477 | A | 6/2019 |
| EP | 3254980 | A1 | 12/2017 |
| EP | 3498616 | A1 | 6/2019 |
| EP | 3656688 | A1 | 5/2020 |
| NO | 300885 | B1 | 8/1997 |

OTHER PUBLICATIONS

International Search Report (PCT/ISA/210) and Written Opinion (PCT/ISA/237) mailed on Oct. 11, 2021, by the European Patent Office as the International Searching Authority for International Application No. PCT/EP2021/067994. (10 pages).

* cited by examiner

PACKAGE FORMING UNIT, PACKAGING APPARATUS HAVING A PACKAGE FORMING UNIT AND METHOD FOR FORMING PACKAGES

TECHNICAL FIELD

The present invention relates to a package forming unit for forming sealed packages of a pourable product, in particular a pourable food product, from a tube formed from a web of packaging material and being filled and/or being fillable with a pourable product.

Advantageously, the present invention also relates to a packaging apparatus having a package forming unit for forming sealed packages of a pourable product, in particular a pourable food product, from a tube formed from a web of packaging material and being filled and/or being fillable with a pourable product.

Advantageously, the present invention also relates to a method for forming packages filled with a pourable product.

BACKGROUND ART

As is known, many liquid or pourable food products, such as fruit juice, UHT (ultra-high-temperature treated) milk, wine, tomato sauce, etc., are sold in packages made of sterilized packaging material.

A typical example is the parallelepiped-shaped package for liquid or pourable food products known as Tetra Brik Aseptic (registered trademark), which is made by sealing and folding a laminated packaging material. The packaging material has a multilayer structure comprising a base layer, e.g. of paper or cardboard, covered on both sides with layers of heat-seal plastic material, e.g. polyethylene. In the case of aseptic packages for long-storage products, such as UHT milk, the packaging material also comprises a layer of oxygen-barrier material (an oxygen-barrier layer), e.g. an aluminum foil, which is superimposed on a layer of heat-seal plastic material, and is in turn covered with another layer of heat-seal plastic material forming the inner face of the package eventually contacting the food product.

Packages of this sort are normally produced on fully automatic packaging apparatuses, which advance a web of packaging material through a sterilization apparatus for sterilizing the web of packaging material at a sterilization station and to an isolation chamber (a closed and sterile environment) in which the sterilized web of packaging material is maintained and advanced. During advancement of the web of packaging material through the isolation chamber, the web of packaging material is folded and sealed longitudinally at a tube forming station to form a tube having a longitudinal seam portion, the tube being further fed along a vertical advancing direction.

In order to complete the forming operations, the tube is filled with a pourable product, in particular a pourable food product, and is formed, transversally sealed and subsequently cut along equally spaced transversal cross sections within a package forming unit of the packaging apparatus during advancement along the vertical advancing direction.

Pillow packages are so obtained within the package forming unit, each pillow package having a longitudinal sealing band, a top transversal sealing band and a bottom transversal sealing band.

A typical packaging forming unit comprises a plurality of jaw units and a conveyor device for advancing the jaw units. Each jaw unit comprises:

two respective operative assemblies being configured to engage the tube from different sides thereof and to form the tube while advancing along respective operative portions of a conveying path;

two sealing elements being configured to engage the tube from different sides thereof and to transversally seal the tube while advancing along respective operative portions of a respective conveying path; and a pair of interaction tabs configured to interact with the tube while advancing along a respective operative portion of a respective conveying path.

Typically, each jaw unit also comprises a cutting assembly for cutting the tube along the transversal sealing band after its formation.

Due to the advancement of the operative assemblies, the sealing elements and the pair of interaction tabs along the respective operative portions and the interaction of these with the tube, the tube is drawn along the tube advancement path.

Even though, such package forming units achieve excellent working results, a desire is felt in the sector to further improve the known package forming units and/or the known packaging apparatuses, in particular so as to allow to further increase the production speeds.

A further desire is felt to also improve the methods for forming the packages, in particular so as to allow to further increase the production speeds.

DISCLOSURE OF INVENTION

It is therefore an object of the present invention to provide an improved package forming unit.

It is a further object of the present invention to provide a packaging apparatus having an improved package forming unit.

It is another object of the present invention to provide a method for forming packages.

According to the present invention, there is provided a package forming unit as claimed in claim 1.

Preferred non-limiting embodiments of the package forming unit are claimed in the dependent claims 2 to 9.

According to the present invention, there is also provided a packaging apparatus according to claim 10 or 11.

According to the present invention, there is also provided a method for forming packages according to claim 12.

Preferred non-limiting embodiments of the method are claimed in the dependent claims 13 to 15.

BRIEF DESCRIPTION OF THE DRAWINGS

A non-limiting embodiment of the present invention will be described by way of example with reference to the accompanying drawings, in which.

BEST MODES FOR CARRYING OUT THE INVENTION

Figure 1:
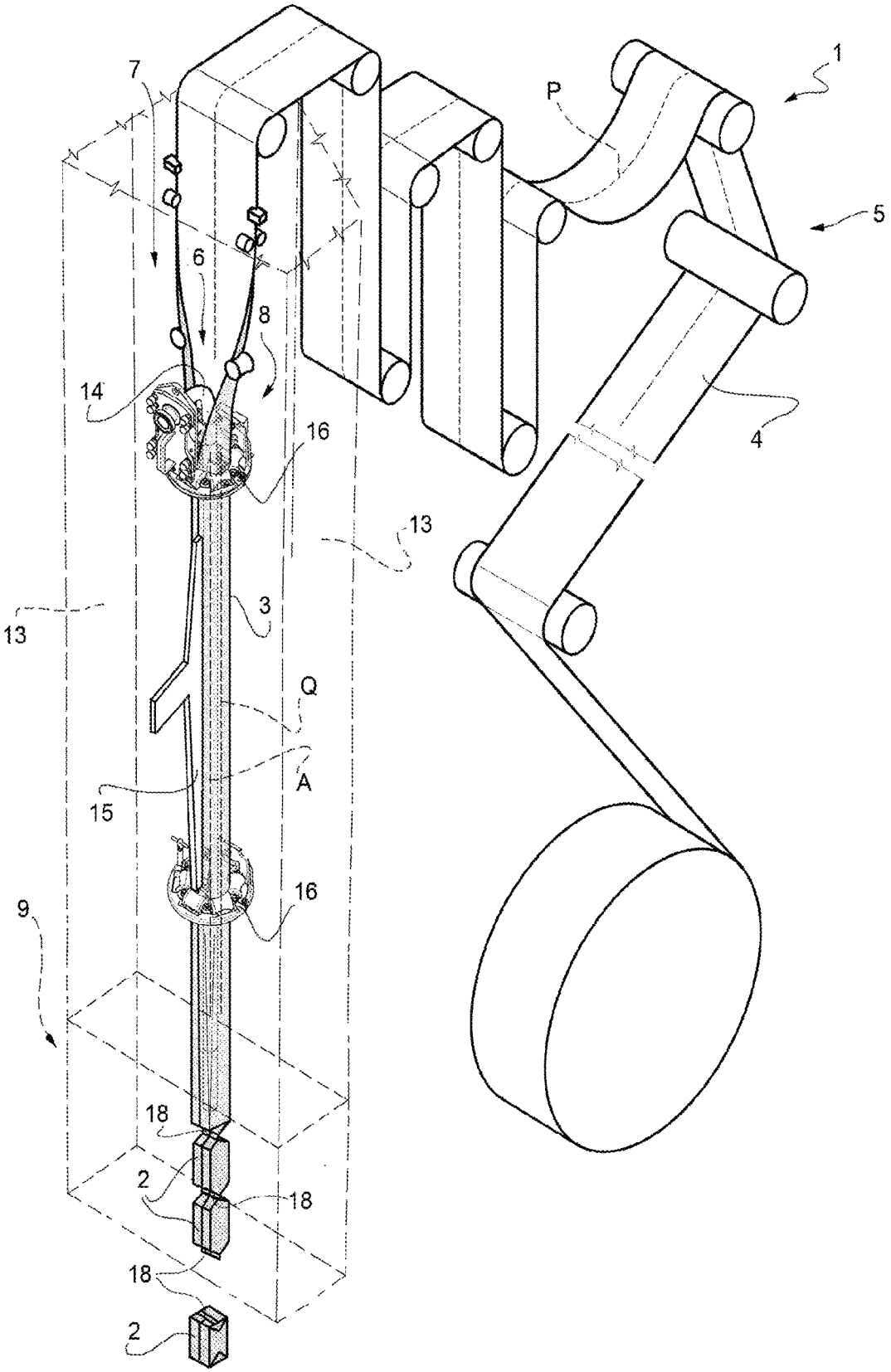
FIG. 1 is a schematic view of a packaging apparatus having a package forming unit according to the present invention, with parts removed for clarity.

Number 1 indicates as a whole a packaging apparatus for producing (sealed) packages 2 of a pourable product, in particular a pourable food product such as pasteurized milk, fruit juice, wine, tomato sauce, etc., from a tube 3 of a web 4 of packaging material.

In particular, in use, tube 3 extends along a longitudinal axis A, preferentially having a vertical orientation.

Web 4 of packaging material has a multilayer structure (not shown), and comprises at least a layer of fibrous material, such as e.g. a paper or cardboard layer, and at least two layers of heat-seal plastic material, e.g. polyethylene, interposing the layer of fibrous material in between one another. One of these two layers of heat-seal plastic material defines the inner face of package 2 eventually contacting the pourable product.

Preferably but not necessarily, web 4 also comprises a layer of gas- and light-barrier material, e.g. aluminum foil or ethylene vinyl alcohol (EVOH) film, in particular being arranged between one of the layers of heat-seal plastic material and the layer of fibrous material. Preferentially but not necessarily, web 4 also comprises a further layer of heat-seal plastic material being interposed between the layer of gas- and light-barrier material and the layer of fibrous material.

According to a preferred non-limiting embodiment, web 4 comprises a first face and a second face, in particular the first face being the face of web 4 forming the inner face of the formed package 2 eventually contacting the filled pourable food product.

According to a preferred non-limiting embodiment, a typical package 2 obtained by packaging apparatus 1 comprises a longitudinal seam portion and a pair of transversal sealing bands, in particular a transversal top sealing band and a transversal bottom sealing band.

With particular reference to FIG. 1, packaging apparatus 1 comprises at least:

a conveying device 5 configured to advance web 4 along a web advancement path P at least to a tube forming station 6 at which web 4 is formed into tube 3; and a tube forming and sealing device 7 configured to form tube 3 from web 4 and to longitudinally seal tube 3 at tube forming station 6;

a filling device 8 configured to fill tube 3 with the pourable product; and a package forming unit 9 configured to at least form and transversally seal tube 3, preferentially to also transversally cut tube 3, for obtaining (sealed) packages 2.

Preferentially, package forming unit 9 is also configured to advance tube 3, in particular in collaboration with conveying device 5, along a tube advancement path Q.

Even more preferentially, package forming unit 9, in particular in collaboration with conveying device 5, is configured to advance tube 3 and any intermediate of tube 3 in a manner known as such along tube advancement path Q. In particular, with intermediates of tube 3 any configuration of web 4 is meant prior to obtaining the tube structure and after folding of web 4 by tube forming and sealing device 7 has started. In other words, the intermediates of tube 3 are a result of the gradual folding of web 4 so as to obtain tube 3, in particular by overlapping opposite lateral edges of web 4 with one another.

According to a preferred non-limiting embodiment, packaging apparatus 1 also comprises at least an isolation chamber 13 housing at least partially tube forming and sealing device 7.

According to a preferred non-limiting embodiment, packaging apparatus 1 also comprises an atmosphere control unit configured to control at least the atmosphere within isolation chamber, in particular so as to form and longitudinally seal, in use, tube 3 within a controlled sterile atmosphere. In particular, the atmosphere control unit is configured to introduce a sterile gas into inner environment 14 and/or to control a positive pressure within isolation chamber 13 being larger than the ambient pressure.

According to a preferred non-limiting embodiment, packaging apparatus 1 further comprises a sterilization apparatus for sterilizing at least a portion of web 4, preferentially at least the first face, even more preferentially the first face and the second face, in particular at a sterilization station arranged upstream of tube forming station 6 along web advancement path P. In particular, the sterilization apparatus is configured to sterilize web 4 by means of physical and/or chemical sterilization.

According to a preferred non-limiting embodiment, packaging apparatus 1 also comprises a magazine unit adapted to host and to provide for web 4 at a host station. In particular, conveying device 5 is configured to advance web 4 from the host station to tube forming station 6.

According to a preferred non-limiting embodiment, tube forming and sealing device 7 is arranged upstream of package forming unit 9.

With particular reference to FIG. 1, filling device 8 comprises at least a filling pipe 14 being in fluid connection or being controllable to be in fluid connection with a pourable product storage tank (not shown and known as such), and in particular, partially extending within isolation chamber 13.

Preferentially, in use, filling pipe 14 is partially placed within tube 3 for feeding the pourable product into the, in use, advancing tube 3.

With particular reference to FIG. 1, tube forming and sealing device 7 comprises at least a tube forming assembly configured to form tube 3 from web 4, in particular by overlapping the respective lateral edges of web 4, and at least a sealing head 15 configured to longitudinally seal tube 3, in particular along the portion of tube 3 obtained by the overlapping of the lateral edges of web 4.

Preferentially but not necessarily, the tube forming assembly and sealing head 15 are arranged within isolation chamber 13.

Preferentially but not necessarily, the tube forming assembly comprises at least a plurality of forming ring assemblies 16, in the particular example shown two, being adapted to fold web 4 gradually into tube 3. In particular, forming ring assemblies 16 are arranged within parallel and spaced apart planes, in particular having a substantially horizontal orientation.

Preferentially but not necessarily, tube forming and sealing device 7 also comprises a pressuring assembly configured to exert a mechanical force on tube 3, in particular for promoting the longitudinal sealing of tube 3. In particular, the pressuring assembly is associated to the forming ring assembly 16 being arranged downstream of the other forming ring assembly 16 along web advancement path P and/or tube advancement path Q.

Figure 2:
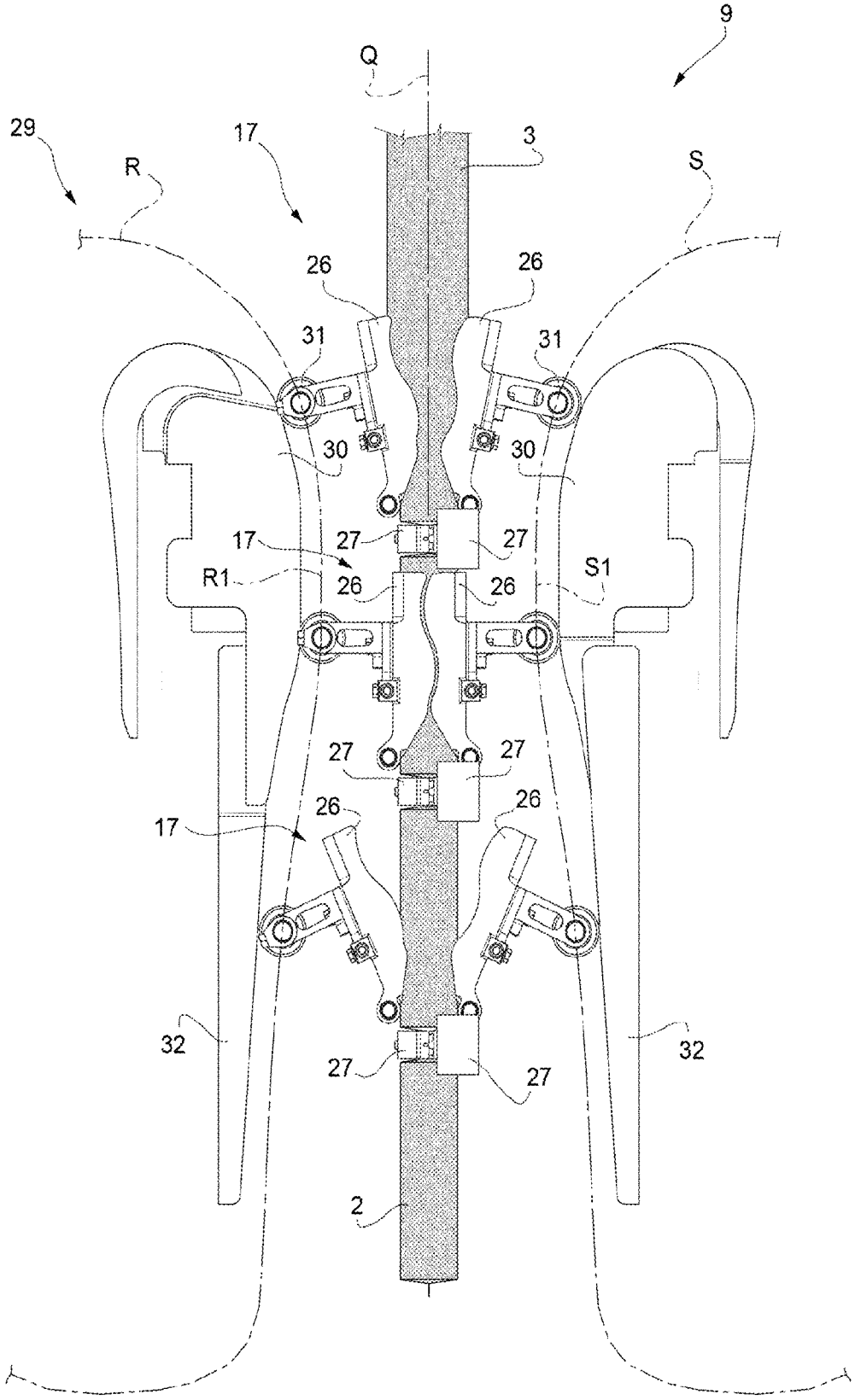
FIG. 2 is a schematic side view of the package forming unit of FIG. 1, with parts removed for clarity.
Figure 3:
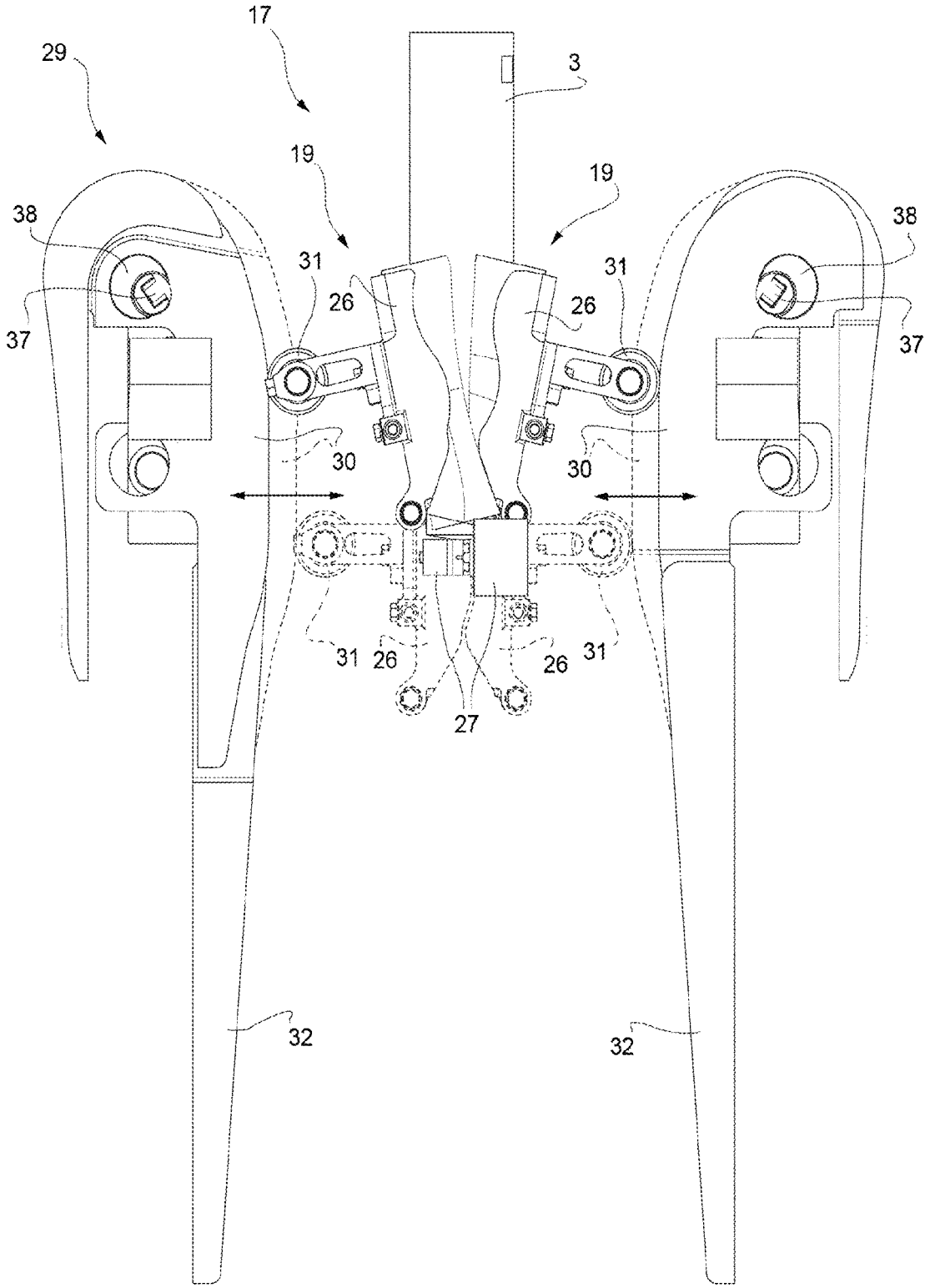
FIG. 3 is a lateral view of a detail of the package forming unit of FIG. 1, with parts removed for clarity.
Figure 4:
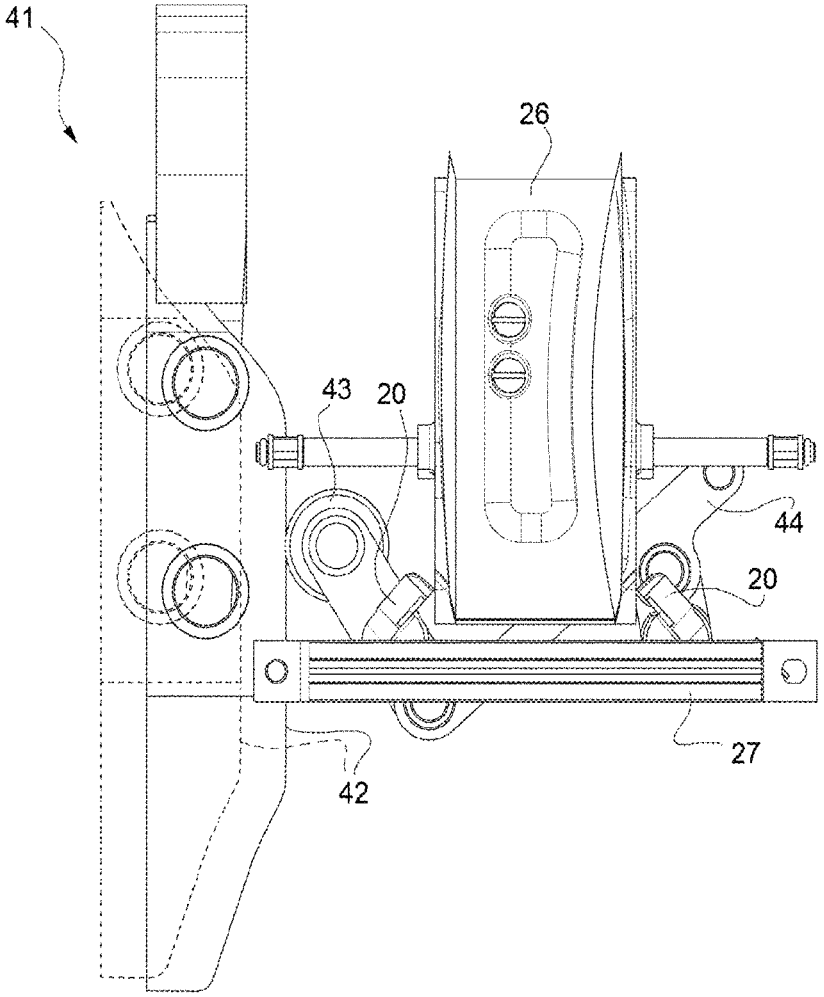
FIG. 4 is a lateral view of another detail of the package forming unit of FIG. 1, with parts removed for clarity.

With particular reference to FIGS. 2 to 4, package forming unit 9 comprises a plurality of jaw units 17, each adapted to form and to at least transversally seal tube 3 for obtaining a respective transversal sealing band 18, and in particular to transversally cut tube 3 along the respective transversal sealing band 18, for obtaining a respective package 2 from tube 3.

In particular, each jaw unit 17 comprises two jaw portions 19 configured to form and transversally seal, in particular to also transversally cut, tube 3 in collaboration with one another. Even more particular, each jaw unit 17 is designed such that one jaw portion 19 is adapted to engage and interact with tube 3 from a first side thereof and the other jaw portion 19 is adapted to engage and interact with tube 3 from a second side (distinct from the first side) thereof.

Furthermore, each jaw unit 17 comprises a pair of interaction tabs 20 being adapted to interact with tube 3. In particular, each pair of interaction tabs 20 is adapted to interact, in use, with tube 3 from opposite sides thereof for selectively exerting a pulling force on tube 3 and/or for promoting a folding of tube 3, in particular at the respective transversal sealing band 18.

Preferentially, each interaction tab 20 is moveable between at least a first limit position in which the respective interaction tab 20 is adapted to engage and interact with tube 3 and a second limit position in which the respective interaction tab 20 is disengaged from tube 3.

It should be noted that within the scope of the present invention, the term "disengaged" means that the respective element, such as e.g. an interaction tab 20 is not adapted to exert its nominal function on tube 3. This also includes the possibility that there may be a contact (e.g. due to fluctuations of tube 3) between the respective elements, such as e.g. an interaction tab 20, and tube 3, however, such a contact is not adapted to exert the required forces so as to obtain the nominal function.

According to some preferred non-limiting embodiments, each pair of interaction tabs 20 is also configured to at least partially control advancement of tube 3 such that tube 3 is in "register". Web 4 comprises a plurality of (substantially) identical patterns arranged one after the other along web 4. In "register" means that once tube 3 is formed, sealed and cut each pattern corresponds to (i.e. is fully contained with) one respective package 2.

According to some preferred non-limiting embodiments, each pair of interaction tabs 20 is connected to one of the respective jaw portions 19.

Preferentially, each jaw unit 17 comprises a cutting assembly configured to cut tube 3 along the respective transversal sealing band 18.

Furthermore, package forming unit 9 comprises a conveying unit configured to advance one respective jaw portion 19 of each jaw unit 17 along an endless conveying path R and to advance the other respective jaw portion 19 along an endless conveying path S (distinct from conveying path R).

Additionally, the conveying unit is also configured to advance each pair of interaction tabs 20 along conveying path R or conveying path S (in dependence on whether the respective pair of interaction tabs 20 is connected to one jaw portion 19 or the other jaw portion 19).

According to some preferred non-limiting embodiments, the conveying unit is of a chain conveyor-type meaning that jaw portions 19 are connected to one another by means of a chain and/or the plurality of jaw portions 19 define a chain.

In particular, the conveying unit comprises a first (chain) conveyor and a second (chain) conveyor parallel and spaced apart from one another and configured to control and/or actuate advancement of jaw portions 19 along respectively conveying path R and conveying path S. Even more particular, one of first conveyor and second conveyor is also configured to advance the pairs of interaction tabs 20.

In more detail, the conveying unit is, in particular the first conveyor and the second conveyor are, configured to advance jaw portions 19 along a respective operative portion R1 or a respective operative portion S1 and during advancement along the respective operative portion R1 or the respective operative portion S1 jaw portions 19 are adapted to engage and interact with tube 3. In particular, jaw portions 19, when advancing along the respective operative portion R1 or the respective operative portion S1 advance (substantially) parallel to and in the same direction as tube 3.

In a similar manner, also each pair of interaction tabs 20 advances along operative portion R1 or operative portion S1.

Preferentially, tube 3 advances, in use, within a space positioned between the first conveyor and the second conveyor.

In more detail, each jaw portion 19 comprises one respective operative assembly 26, in particular each having a respective half-shell, adapted to engage tube 3 and to at least partially form the, in use, advancing tube 3 and one respective sealing element 27 adapted to at least partially transversally seal tube 3 along transversal sealing band 18.

In particular, each operative assembly 26 is adapted to contact tube 3 and to at least partially form tube 3 for at least partially defining the shape of packages 2.

In particular, each operative assembly 26 is adapted to cooperate with the other respective operative assembly 26 for forming tube 3 in a manner known as such and not further explained.

In particular, each half-shell comprises one main plate and two auxiliary lateral plates protruding from the respective main plate.

In particular, each sealing element 27 is adapted to cooperate with the other respective sealing element 27 so as to transversally seal tube 3 along transversal sealing band 18 in a manner known as such and not further explained.

Preferentially, the conveying unit is, in particular the first conveyor and the second conveyor are, configured to advance the respective operative assemblies 26 and the respective sealing elements 27 along the respective conveying path R or the respective conveying path S and, accordingly also along the respective operative portion R1 or the respective operative portion S1.

Advantageously, packaging apparatus 1, in particular package forming unit 9, comprises a control unit configured to control operation of at least jaw units 17.

Advantageously, the control unit is configured to control:

operative assemblies 26 in at least a respective active state (see FIG. 2) in which the respective operative assembly 26 is configured to engage the, in use, advancing tube 3 for at least partially forming tube 3 and a respective inactive state (see FIG. 2) in which the respective operative assembly 26 is disengaged from the, in use, advancing tube 3;

the pairs of interaction tabs 20 between a respective active state in which each pair of interaction tabs 20 is configured to interact with the, in use, advancing tube 3 and a respective inactive state (see FIG. 4) in which each pair of interaction tabs 20 is disengaged (detached) from tube 3; and sealing elements 27 while advancing, in use, along the respective operative portion R1 or the respective operative portion S1, in a respective active state in which each sealing element 27 is configured to engage the, in use, advancing tube 3 and to at least partially transversally seal the tube 3 for forming the respective transversal sealing band 18.

Advantageously, the control unit is also configured to control operative assemblies 26 in at least the active state, preferentially to selectively control operative assemblies 26 in the respective active state or the respective inactive state, during their advancement along the respective operative portion R1 or the respective operative portion S1.

In addition and/or in alternative, the control unit is configured to control the pairs of interaction tabs 20 in at least the active state, preferentially to selectively control the pair of interaction tabs 20 in the respective active state or the respective inactive state, during their advancement along the respective operative portion R1 or the respective operative portion S1.

Preferentially, the control unit is also configured to control operative assemblies 26 and the pairs of interaction tabs 20 in the respective inactive states while advancing, in use, along portions of the respective conveying path R or the respective conveying path S different from the respective operative portion R1 or the respective operative portion S1.

Preferentially, the control unit is also configured to control sealing elements 27 in the respective inactive state, in which sealing elements 27 are disengaged from tube 3 while advancing, in use, along portions of the respective conveying path R or the respective conveying path S different from the respective operative portion R1 or the respective operative portion S1.

Preferentially, the control unit is also configured to control each operative assembly 26 into one or more intermediate states in which the respective operative assembly 26 is in contact with tube 3, and in particular in which the respective operative assembly 26 is configured to execute a supporting operation and/or function and/or in which the respective operative assembly 26 is withdrawn from and/or engaged onto tube 3.

Preferentially, each half-shell is angularly moveable around a respective rotation axis for controlling the respective operative assembly 26 between the respective active state and the respective inactive state. In particular, each half-shell is angularly moveable between a first angular position and a second angular position in which the respective half-shell is in respectively the active state and the inactive state. Even more particular, each half-shell is arranged in one respective intermediate state with the respective half-shall being arranged at a respective angular position intermediate between the first angular position and the second angular position.

Preferentially, the control unit is also configured to control each pair of interactions tabs 20 into one or more respective intermediate states in which the respective interaction tabs 20 are in contact with tube 3, and in particular in which the respective interactions tabs 20 are configured to execute a supporting operation and/or function and/or in which the respective interaction tabs are withdrawn from and/or engaged onto tube 3.

Preferentially, each jaw unit 17 is configured such that the respective half-shells, in particular the respective main plates, of each jaw unit 17 are (substantially) parallel to one another with the respective operative assemblies being controlled in the respective active states.

Preferentially, each jaw unit 17 is configured such that the respective half-shells, in particular the respective main plates, of each jaw unit 17 describe a V-shape with the respective operative assemblies 26 being controlled in the respective inactive states.

Preferentially, an angle between the respective half-shells and a plane being perpendicular to longitudinal axis A ranges between 87° to 93°, in particular equals (substantially) 90°, with the respective operative assembly 26 being controlled in the active state and ranges between 95° to 105°, in particular between 97° to 103°, with the respective operative assembly 26 being controlled in the inactive state.

Preferentially, each pair of interaction tabs 20 is controlled between the respective active state and the respective inactive state by respectively approaching and withdrawing the respective interaction tabs 20 to and from one another.

Advantageously, the control unit is also configured to control each jaw unit 17 as a function of the filling level of tube 3 and/or the operation of filling device 8 in at least:

an operative configuration in which the respective operative assemblies 26, the respective sealing elements 27 and the respective pair of interaction tabs 20 are controlled in the respective active states while advancing, in use, along the respective operative portions R1 or the respective operative portions S1 for forming and transversally sealing tube 3; and a partial operative configuration (see FIGS. 3 and 4) in which the respective sealing elements 27 are controlled in the respective active states and at least one of the respective operative assemblies 26, preferentially both respective operative assemblies 26, and/or the respective pair of interaction tabs 20 is/are controlled in the respective inactive state(s) while, in use, advancing along the respective operative portion R1 or the respective operative portion S1.

It should be noted that the term "filling level" as used within the present description is a measure of the volume of the pourable product present within tube 3.

In this manner, it is possible to avoid any significant contact between operative assemblies 26 and/or interaction tabs 20 with tube 3 even though the respective jaw portions 19 advance along the respective operative portions R1 or the respective operative portions S1. In particular, it has been found that such a contact can lead to a damaging of tube 3 and/or packages 2 when operating at elevated production speeds and with the filling level being below a determined filling level or above a determined further filling level.

According to some preferred non-limiting embodiments, the control unit is configured to control jaw units 17 in the partial operative configuration if the filling level of tube 3 is below a determined filling level and/or if operation of filling device 8 differs from a determined nominal operating condition and/or if filling device 8 is switched off.

In particular, such conditions are typically present during the start and the end of operation of package forming unit 9 and/or packaging apparatus 1 and/or during operation of package forming unit 9 and/or packaging apparatus 1 and a temporal full or partial interruption of operation of at least filling device 8.

With particular reference to FIGS. 3 to 6, the control unit comprises a cam mechanism configured to interact with operative assemblies 26 and with the pairs of interaction tabs 20 during their advancement along the respective operative portion R1 or the respective operative portion S1 and an adjustment assembly operatively coupled to the cam mechanism for controlling operative assemblies 26 and the pairs of interaction tabs 20 in the respective active state or the respective inactive state during their advancement along the respective operative portion R1 or the respective operative portion S1.

With particular reference to FIG. 3, the cam mechanism comprises a first cam assembly 29 configured to control operative assemblies 26 in the respective inactive state or the respective active state during their advancement along the respective operative portion R1 or the respective operative portion S1.

In more detail, first cam assembly 29 comprises a pair of cam profiles 30 configured to interact with operative assemblies 26 and each cam profile 30 being (linearly) moveable between at least a first limit position (see the dashed view of cam profile 30) and a second limit position (see the solid view of cam profile 30) in which operative assemblies 26 are controlled in respectively the respective active position and the respective inactive position. In particular, the respective first limit position and/or the respective second limit position of each cam profile 30 is, in use, controllable so as to control operation of operative assemblies 26 for determining specific parameters (such as the volume of the pourable product present within packages 2) of packages 2.

In particular, cam profiles 30 are spaced apart from, and in particular are parallel, to one another. Even more particular, cam profiles 30 are approached with respect to one another (the dashed view in FIG. 3) when being in the respective first limit position and are withdrawn with respect to one another (the solid view in FIG. 3) when being controlled in the second limit position.

In particular, cam profiles 30 are designed such to control an angular movement of the half-shells around the respective rotation axes during advancement of the respective operative assemblies 26.

Preferentially, first cam assembly 29 comprises a plurality of first cam followers 31, each one connected to one respective operative assembly 26 and configured to operatively couple the respective operative assembly 26 to the respective cam profile 30.

In particular, cam profiles 30 are, in use, closer to tube 3 when being arranged in the respective first limit position than when being arranged in the respective second limit position.

Preferentially, the adjustment assembly comprises a first actuator 35 is connected to cam profiles 30 and configured to move, in particular to simultaneously move, cam profiles 30 between the respective first limit position and the respective second limit position, for controlling operative assemblies 26 in respectively the corresponding active state and the corresponding inactive state during their advancement along the respective operative portion R1 or the respective operative portion S1.

Preferentially, first cam assembly 29 also comprises a pair of fixed cam profiles 32, each one arranged downstream of one respective cam profile 30 with respect to the respective conveying path R or the respective conveying path S. In particular, fixed cam profiles 32 are configured to control operative assemblies 26 in the respective inactive states with the respective jaw units 19 being controlled in the respective operative configuration.

Figure 5:
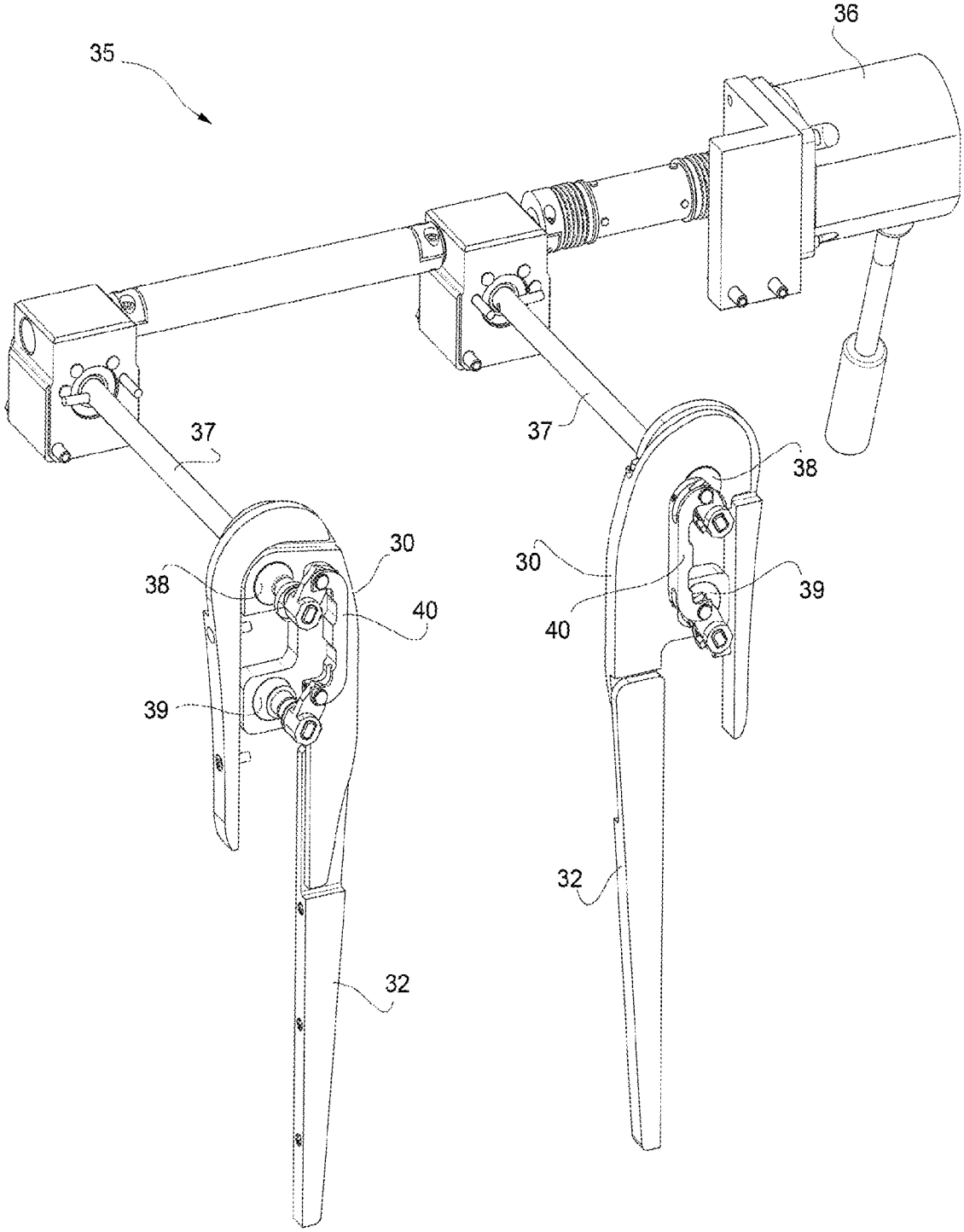
FIG. 5 is a perspective view of a portion of the package forming unit of FIG. 1, with parts removed for clarity.

With particular reference to FIG. 5, first actuator 35 comprises at least an electrical motor 36 and two control bars 37 operatively coupled to electrical motor 36 and each one to one respective cam profile 30. In particular, electrical motor 36 is configured to actuate a rotation of control bars 37 so as to move cam profiles 30 between the respective first limit positions and the respective second limit positions.

Preferentially, first actuator 35 also comprises at least two main eccentric 38, each connected to one respective control bar 37 and one respective cam profile 30 and configured to transform the rotational movement of the respective control bar 37 into a linear movement of the respective cam profile 30.

Even more preferentially, first actuator 35 also comprises at least two auxiliary eccentric 39, each coupled to one respective cam profile 30, and two coupling groups 40, each one coupled to one respective control bar 37 and to one respective auxiliary eccentric 39 for coupling the respective auxiliary eccentric 39 to the respective control bar 37.

In particular, each auxiliary eccentric 39 is designed to contribute to the transformation of the rotational movement of the respective control bar 37 into the linear movement.

With particular reference to FIG. 4, the cam mechanism also comprises a second cam assembly 41 configured to control the pairs of interaction tabs 20 in the respective inactive state or the respective active state, in particular also in one or more the respective intermediate states, during their advancement along the respective operative portion R1.

In particular, second cam assembly 41 comprises a moveable cam profile 42 moveable, in particular linearly moveable, between at least a first extreme position (see the solid view of cam profile 42 in FIG. 4) and a second extreme position (see the dashed view of cam profile 42 in FIG. 4) for controlling the pairs of interaction tabs 20 in respectively the active state and the inactive state.

Preferentially, the cam mechanism also comprises a plurality of cam followers 43, each one coupled to one respective pair of interaction tabs 20 and configured to operatively couple the pairs of interaction tabs 20 to cam profile 43.

Preferentially, each jaw unit 17 comprises a lever mechanism 44 carrying the respective cam follower 43, being connected to the respective pair of interaction tabs 20 and being configured to move the pair of interactions tabs 20 between the active state and the inactive state in dependence of the respective cam follower 43 engaging, in use, cam profile 42. In particular, each lever mechanism 44 is designed such to induce a simultaneous movement of the relative interaction tabs 20 of the respective pair of interaction tabs 20 in function of the interaction between the respective cam follower 43 and cam profile 42.

Preferentially, second cam assembly 41 also comprises a fixed cam profile 45 arranged downstream of cam profile 42 with respect to conveying path R or conveying path S. In particular, fixed cam profile 45 is configured to control the pairs of interaction tabs 20 in the respective inactive states with the respective jaw units 19 being controlled in the respective operative configuration.

Figure 6:
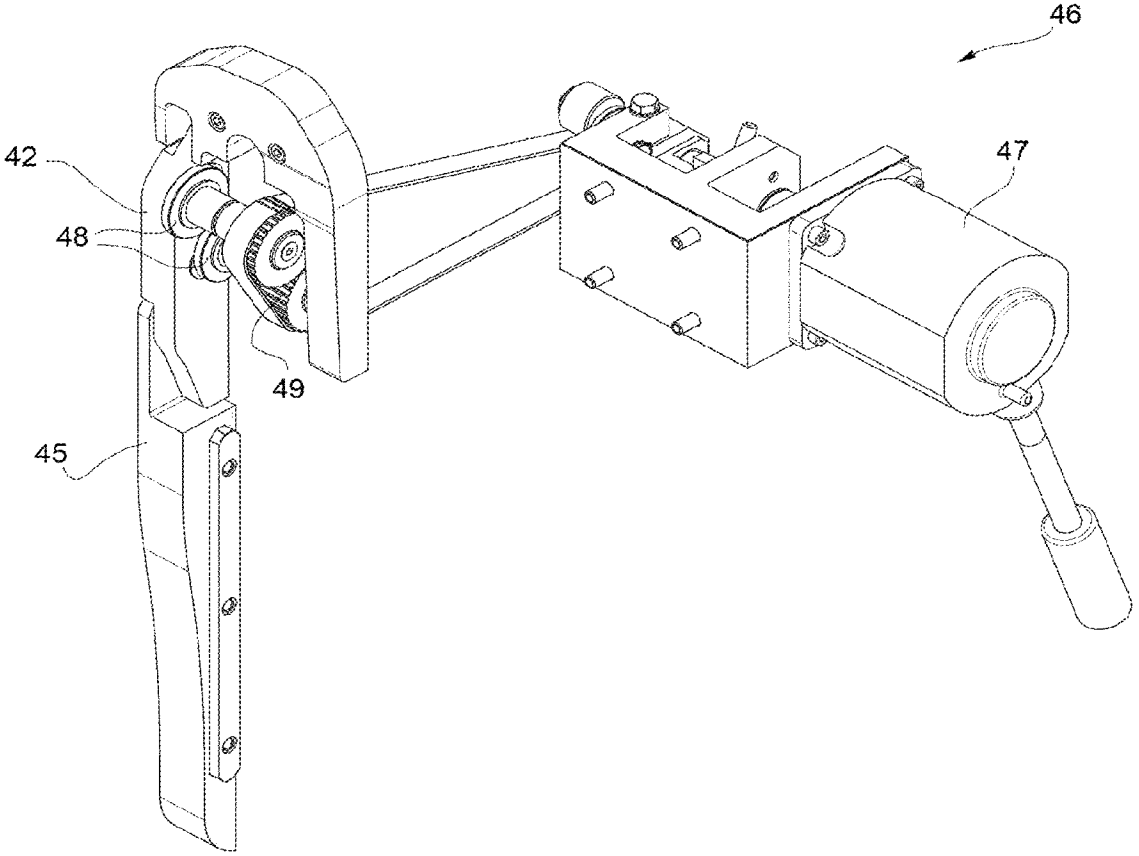
FIG. 6 is a perspective view of another portion of the package forming unit of FIG. 1, with parts removed for clarity.
Figure 7:
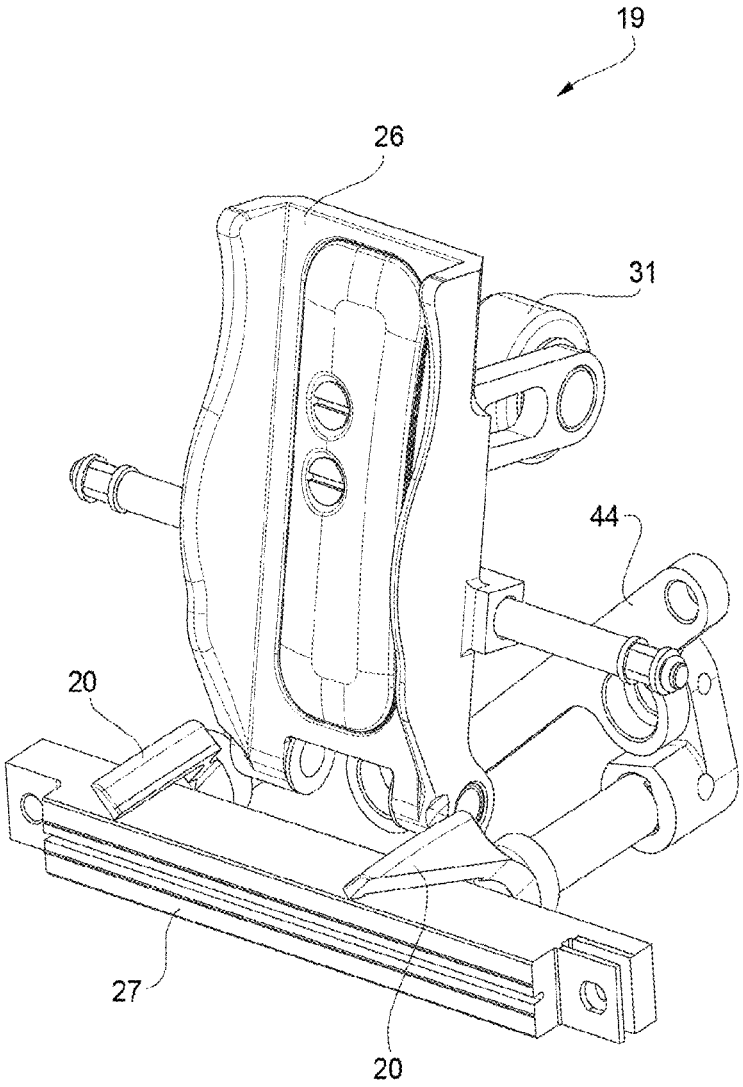
FIG. 7 is a perspective view of an even other portion of the package forming unit of FIG. 1, with parts removed for clarity.

With particular reference to FIG. 6, the adjustment assembly comprises a second actuator 46 that is operatively coupled to cam profile 42 and is configured to (linearly) move cam profile 42 between the first extreme position and the second extreme position for controlling the pairs of interaction tabs 20 in respectively the respective active state and the respective inactive state.

In more detail, second actuator 46 comprises at least an electrical motor 47, one or more eccentrics 48 coupled to electrical motor 47 and to cam profile 42 and coupling means 49 for coupling electrical motor 47 to eccentric(s) 48. In particular, eccentric(s) 48 is/are configured to transform a rotational movement of electrical motor 47 into the linear movement of cam profile 42.

In use, packaging apparatus 1 produces packages 2 of a pourable product. In particular, packaging apparatus 1 forms tube 3 from web 4, longitudinally seals tube 3, fills tube 3 with the pourable product and forms, transversally seals and transversally cuts tube 3 so as to obtain packages 2.

In particular, conveying device 5 advances web 4 along web advancement path P.

In particular, the sterilization apparatus sterilizes web 4 at the sterilization station.

In particular, tube forming and sealing device 7 forms web 4 into tube 3 and longitudinally seals tube 3.

In particular, filling device 8 fills tube 3 with the pourable product.

Advantageously, package forming unit 9 forms, transversally seals, and in particular transversally cuts, tube 3 for obtaining packages 2.

In particular, operation of package forming unit 9 comprises the step of advancing jaw portions 19, in particular operative assemblies 26, sealing elements 27 and the pairs of interaction tabs 20 along the respective conveying path R or the respective convening path S.

Advantageously, operation of package forming unit 9 also comprises:

a first step of controlling, during which operative assemblies 26 are controlled in the active state or the inactive state during their advancement along the respective operative portion R1 or the respective operative portion S1; and/or a second step of controlling the pairs of interaction tabs 20, during which the pairs of interaction tabs 20 are controlled in the active state or the inactive state during their advancement along the respective operative portion R1 or the respective operative portion S1.

Advantageously, operation of package forming unit 9 also comprises a step of transversal sealing, during which sealing elements 27 are controlled in their active state during their advancement along the respective operative portion R1 or the respective operative portion S1 for obtaining the respective transversal sealing bands 18.

Advantageously, operation of package forming unit 9 also comprises a step of cutting, during which tube 3 is cut along transversal sealing bands 18. In particular, the step of cutting is actuated after and/or during the step of transversal sealing.

Advantageously, operation of package forming unit 9 also comprises a third step of controlling, during which jaw units 17 are controlled in the operative configuration or in the partially operative configuration in dependence of the filling level of tube 3 and/or in dependence of the operation of filling device 8.

In particular, during the third step of controlling, each jaw unit (17) is controlled in the partial operative configuration if the filling level of tube 3 is below a determined filling level and/or if during the step of filling, the amount of the pourable product entering tube 3 is below a threshold value.

In more detail, during the first step of controlling, a position of cam profiles 30 is controlled so as to control operative assemblies 26 in the active state or the inactive state.

In particular, during the first step of controlling, each cam profile 30 is linearly moved, in particular by the adjustment assembly, even more particular by first actuator 35, between the respective first limit position and the respective second limit position for controlling the respective position of the respective cam profile 30 and for controlling operative assemblies 26 between the respective active states and inactive states.

Even more particular, first cam profiles 30 are simultaneously moved during the first step of controlling.

In even more detail, during the first step of controlling, electrical motor 36 actuates a rotation of control bars 37, which leads to rotation of main eccentrics 38, and in particular also auxiliary eccentrics 39, which actuates the translation of cam profiles 30.

Preferentially, during the second step of controlling, the position of cam profile 42 is controlled for controlling the pairs of interaction tabs 20 in the active state or the inactive state. In particular, second actuator 46 linearly moves cam profile 42 between the first extreme position and the second extreme position so as to control the pairs of interaction tabs 20 between the active state and the inactive state. Even more particular, electrical motor 47 actuates a rotation of eccentrics 48, which results in translation of cam profile 42.

The advantages of package forming unit 9 and/or packaging apparatus 1 and/or the method according to the present invention will be clear from the foregoing description.

In particular, by controlling operative assemblies 26 and/or the pairs of interaction tabs 20 in the inactive state during their advancement along the respective operative portion R1 or the respective operative portion S1, it is possible to avoid any contact with tube 3 in situations for which such a contact may be undesirable.

A particular advantage, resides in the possibility to avoid contact between operative assemblies 26 and/or the pairs of interaction tabs 20 with tube 3 in a situation in which tube 3 is filled with a quantity of the pourable product, which is below a desired threshold. Such situations may occur at the beginning or at the end of the operation of package forming unit 9 and/or packaging apparatus 1. Additionally, such a situation may occur during the operation of package forming unit 9 and/or packaging apparatus 1 and if the operation needs to be at least partially interrupted.

Clearly, changes may be made to package forming unit 9 and/or packaging apparatus 1 and/or the method as described herein without, however, departing from the scope of protection as defined in the accompanying claims.

The invention claimed is:

1. Package forming unit for forming sealed packages filled with a pourable product from an advancing tube formed from a web of packaging material and being filled or fillable with the pourable product;

the package forming unit comprises at least:

a plurality of jaw units each having at least one respective operative assembly adapted to engage the tube and to at least partially form the, in use, advancing tube, one respective sealing element adapted to at least partially transversally seal the tube along a transversal sealing band and at least a pair of interaction tabs adapted to interact with the tube;

a conveying unit configured to advance each operative assembly, each sealing element and each pair of interaction tabs along respective endless conveying paths; and a control unit configured to control operation of the jaw units;

wherein the control unit is configured to control:

each operative assembly while, in use, advancing along an operative portion (R1; S1) of the respective conveying path in at least a respective active state in which the respective operative assembly is configured to engage the, in use, advancing tube for at least partially forming the tube; and each pair of interaction tabs (20) while, in use, advancing along an operative portion of the respective conveying path in at least a respective active state in which each pair of interaction tabs is configured to interact with the, in use, advancing tube; and each sealing element while advancing, in use, along a respective operative portion of the respective conveying path in a respective active state in which each sealing element is configured to engage the, in use, advancing tube and to at least partially transversally seal the tube for forming the transversal sealing band;

wherein the control unit is also configured to control:

each operative assembly while, in use, advancing along an operative portion of the respective conveying path in a respective inactive state in which the respective operative assembly is disengaged from the, in use, advancing tube; and/or each pair of interaction tabs while, in use, advancing along an operative portion of the respective conveying path in at least a respective inactive state in which each pair of interaction tabs is disengaged from the tube;

wherein the control unit is further configured to control each jaw unit as a function of the filling level of the tube in at least:

an operative configuration in which the respective operative assembly, the respective sealing element and the respective pair of interaction tabs are controlled in the respective active states while advancing along the respective operative portions for at least forming and transversally sealing the tube; and a partial operative configuration in which the respective sealing element is controlled in the respective active state and the respective operative assembly and/or the respective pair of interaction tabs is controlled in the respective inactive state while, in use, advancing along the respective operative portion.

2. Package forming unit according to claim 1, wherein the control unit is configured to control each jaw unit in the partial operative configuration if the filling level of the tube is below a determined filling level.

3. Package forming unit according to claim 1 or 2, wherein the control unit comprises a cam mechanism configured to interact with the operative assemblies and/or with each pair of interaction tabs during their advancement along the respective operative portions and an adjustment assembly operatively coupled to the cam mechanism for controlling the operative assemblies and/or the pairs of interaction tabs in the respective active state or the respective inactive state during their advancement along the respective operative portions.

4. Package forming unit according to claim 3, wherein the cam mechanism comprises a first cam assembly configured to control the operative assemblies in the respective inactive state or the respective active state during their advancement along the operative portion;

wherein the first cam assembly comprises a first cam profile configured to interact with the operative assemblies;

wherein the adjustment assembly is configured to move the first cam profile for controlling the operative assemblies in the active state or the inactive state during their advancement along the operative portion.

5. Package forming unit according to claim 4, wherein the adjustment assembly comprises at least one first actuator connected to the first cam profile and configured to move the first cam profile between at least a first limit position and a second limit position in which the operative assemblies are controlled in, respectively, the respective active position and the respective inactive position.

6. Package forming unit according to claim 5, wherein the first actuator comprises at least an electrical motor, at least one control bar operatively coupled to the electrical motor and the first cam profile connected to the control bar and the first cam profile;

wherein the electrical motor is configured to actuate a rotation of the control bar and the main eccentric is configured to transform the rotation of the control bar into a translation of the first cam profile between the first limit position and the second limit position.

7. Package forming unit according to claim 3, wherein the cam mechanism comprises a second cam assembly configured to control each pair of interaction tabs in the respective inactive state or the respective active state during its advancement along the respective operative portion;

wherein the second cam assembly comprises a moveable cam profile operatively coupled to the adjustment assembly;

wherein the adjustment assembly is configured to move the moveable cam profile for controlling each pair of interaction tabs in the respective inactive state or the respective active state.

8. Package forming unit according to claim 1, wherein the conveying unit comprises at least one chain conveyor carrying the operative assemblies, the sealing elements and the pairs of interaction tabs.

9. Package forming unit according to claim 1, wherein each jaw unit comprises a further operative assembly adapted to engage the tube and to partially form the tube and a further sealing element adapted to engage the tube and to at least partially transversally seal the tube along the transversal sealing band;

wherein the respective operative assembly) is adapted to engage the tube from one side of the tube and the further operative assembly is adapted to engage the tube from an opposite side of the tube so as to form the tube in collaboration with one another;

wherein the sealing element is adapted to engage the tube from one side of the tube and the further sealing element is adapted to engage the tube from an opposite side of the tube so as to transversally seal the tube along the transversal sealing band in collaboration with one another;

wherein the conveying unit is configured to advance the further operative assembly and the further sealing element along respective endless conveying paths;

wherein the control unit is configured to control the further operative assembly while, in use, advancing along an operative portion of the respective conveying path between a respective active state in which the further operative assembly is configured to engage the, in use, advancing tube for at least forming the tube in collaboration with the respective operative assembly and a respective inactive state in which the further operative assembly is disengaged from the, in use, advancing tube; and the further sealing element while advancing, in use, along a respective operative portion of the respective conveying path in a respective active state in which the further sealing element is configured to engage the, in use, advancing tube and to transversally seal the tube in collaboration with the respective sealing element for forming the transversal sealing band;

wherein the control unit is configured to control each jaw unit such that with the respective jaw unit being controlled in the operative configuration the respective operative assembly and the respective further operative assembly, the respective sealing element and the respective further sealing element and the respective pair of interaction tabs are controlled in the respective active states while advancing along the respective operative portions for forming and transversally sealing the tube; and such that with the respective jaw unit being controlled in the partial operative configuration in which the respective sealing element and the respective further sealing element are controlled in the respective active state and the respective operative assembly and/or the respective further operative assembly and/or the respective pair of interaction tabs is/are controlled in the respective inactive state while, in use, advancing along the respective operative portion.

10. Packaging apparatus for forming sealed packages filled with a pourable product from a web of packaging material;

the packaging apparatus comprises at least:

a conveying device configured to advance the web of packaging material along a web advancement path at least to a tube forming station; and a tube forming and sealing device configured to form the tube from the web of packaging material and to longitudinally seal the tube at the tube forming station;

a filling device configured to fill the tube with the pourable product; and a package forming unit according to claim 1 configured to form sealed packages from the tube.

11. Packaging apparatus according to claim 10, wherein the control unit of the package forming unit controls the jaw units in the operative configuration or the partial operative configuration in dependence of the operation of the filling device and/or the filling level of the tube.

12. Method for forming sealed packages filled with a pourable product from an advancing tube formed from a web of packaging material;

the method comprises at least the stops of:

advancing the tube along a tube advancement path;

filling the tube with the pourable product;

providing a plurality of jaw units each having at least one respective operative assembly adapted to engage the tube and to at least partially form the, in use, advancing tube, one respective sealing element adapted to at least partially transversally seal the tube along a transversal sealing band and a pair of interaction tabs adapted to interact with the tube;

advancing the operative assemblies, the sealing elements and the pairs of interaction tabs along respective endless conveying paths;

controlling each operative assembly during its advancement along an operative portion of the respective conveying path in at least a respective active state in which the respective operative assembly engages the advancing tube for at least partially forming the tube;

controlling each pair of interaction tabs during their advancement along an operative portion of the respective conveying path in at least a respective active state in which each pair of interaction tabs interacts with the advancing tube and a respective inactive state in which each pair of interaction tabs is disengaged from the tube;

controlling each sealing element during its advancement along a respective operative portion of the respective conveying path in a respective active state in which each sealing element engages the advancing tube and to at least partially transversally seal the tube for forming the transversal sealing band; and controlling each jaw unit as a function of the filling level of the tube in at least:

an operative configuration in which the respective operative assembly, the respective sealing element and the respective pair of interaction tabs are controlled in the respective active states while advancing along the respective operative portions for at least forming and transversally sealing the tube; and a partial operative configuration in which the respective sealing element is controlled in the respective active state and the respective operative assembly and/or the respective pair of interaction tabs is/are controlled in a respective inactive state while advancing along the respective operative portion in which the respective operative assembly and/or the respective pair of interaction tabs is/are disengaged from the advancing tube.

13. Method according to claim 12, wherein during the step of controlling the jaw units, each jaw unit is controlled in the partial operative configuration if the filling level of the tube is below a determined filling level.

14. Method according to claim 12, wherein during the step of controlling the operative assemblies, a first cam profile operatively coupled to the operative assemblies during advancement of the operative assemblies along the operative portion is positioned so as to control the operative assemblies in the active state or the inactive state.

15. Method according to claim 12, wherein during the step of controlling the respective pair of interaction tabs, a second cam profile operatively coupled to the respective pair of interaction tabs during advancement of the pair of interaction tabs along the operative portion is positioned so as to control the respective pair of interaction tabs in the active state or the inactive state.

* * * * *